US008221271B1

(12) United States Patent
McIntyre

(10) Patent No.: US 8,221,271 B1
(45) Date of Patent: Jul. 17, 2012

(54) STANCE AND ROTATIONAL SWING TRAINER

(76) Inventor: Matthew S. McIntyre, Trussville, AL (US)

( * ) Notice: Subject to any disclaimer, the term of this patent is extended or adjusted under 35 U.S.C. 154(b) by 100 days.

(21) Appl. No.: 12/751,464

(22) Filed: Mar. 31, 2010

Related U.S. Application Data

(60) Provisional application No. 61/165,243, filed on Mar. 31, 2009.

(51) Int. Cl.
*A63B 69/00* (2006.01)
*A63B 69/36* (2006.01)

(52) U.S. Cl. ..... 473/452; 473/272

(58) Field of Classification Search ..... 473/451–454, 473/270–273
See application file for complete search history.

(56) References Cited

U.S. PATENT DOCUMENTS

| | | | | | |
|---|---|---|---|---|---|
| 2,189,613 | A | | 2/1940 | Paulsen | |
| 2,711,320 | A | | 6/1955 | Clark | |
| 3,342,487 | A | | 9/1967 | David | |
| 3,363,903 | A | * | 1/1968 | O'Brien | 473/273 |
| 3,372,930 | A | * | 3/1968 | Sertich | 473/452 |
| 3,466,040 | A | * | 9/1969 | Sertich | 473/452 |
| 3,955,821 | A | | 5/1976 | Spedding | |
| 3,979,116 | A | | 9/1976 | Matchick | |
| 4,023,810 | A | | 5/1977 | Lorang | |
| 4,146,231 | A | * | 3/1979 | Merkle et al. | 473/269 |
| 4,194,735 | A | | 3/1980 | Wilson | |
| 4,225,133 | A | | 9/1980 | Kiray | |
| 4,322,084 | A | * | 3/1982 | Reece et al. | 473/273 |
| 4,516,772 | A | | 5/1985 | Stratton | |
| 4,657,258 | A | * | 4/1987 | Melov et al. | 473/272 |
| 4,932,656 | A | * | 6/1990 | Pierce | 473/452 |
| 5,037,094 | A | | 8/1991 | Johnson | |
| 5,076,580 | A | | 12/1991 | Lang | |
| 5,263,863 | A | | 11/1993 | Stefani et al. | |
| 5,318,290 | A | | 6/1994 | Sawyer | |
| 5,330,176 | A | * | 7/1994 | Cagney, Jr. | 473/452 |
| 5,385,343 | A | * | 1/1995 | Davis, Sr. | 473/452 |
| D399,280 | S | * | 10/1998 | Griffin | D21/753 |
| 5,976,027 | A | * | 11/1999 | Kachmar | 473/273 |
| 6,102,818 | A | | 8/2000 | Hamilton | |
| 6,422,872 | B1 | | 7/2002 | Outlaw | |
| 6,432,001 | B1 | * | 8/2002 | Pierce | 473/452 |
| 6,500,078 | B1 | | 12/2002 | Williams et al. | |
| 6,723,004 | B1 | * | 4/2004 | Florian | 473/270 |

(Continued)

OTHER PUBLICATIONS

Schutt Stride Guide Baseball Stance Trainer, MSN Shopping, fogdog sports, 2 pages, printed on Mar. 14, 2005.

*Primary Examiner* — Mark Graham
(74) *Attorney, Agent, or Firm* — Angela Holt; Bradley Arant Boult Cummings LLP

(57) ABSTRACT

A stance and rotational swing training device is provided. The device comprises a base with a front foot stop adjustably attached to a top surface of the base for receiving a user's front foot. The user's back foot is received by a rotatable foot pedal rotatably attached to the top surface of the base. The rotatable foot pedal comprises a circular base with a peripheral toe stop that prevents the user's toes from sliding off the foot pedal. An angled riser is rigidly affixed to the top surface of the base adjacent to the foot pedal. The riser guides the heel end of the user's back foot and forces the heel to rise as the user swings a sporting implement, such as a baseball bat or golf club.

7 Claims, 7 Drawing Sheets

U.S. PATENT DOCUMENTS

| | | | | |
|---|---|---|---|---|
| 6,749,529 | B1 * | 6/2004 | Sobolewski | 473/451 |
| 6,926,625 | B1 | 8/2005 | Fruechting | |
| 7,125,350 | B1 * | 10/2006 | Reason-Kerkhoff | 473/452 |
| 7,335,117 | B2 | 2/2008 | Reason-Kerkhoff | |
| 7,468,010 | B2 | 12/2008 | Du Brock | |
| D602,553 | S * | 10/2009 | Wright | D21/780 |
| D620,064 | S * | 7/2010 | McIntyre | D21/780 |
| 7,775,914 | B1 * | 8/2010 | Greene | 473/452 |
| 2006/0046864 | A1 * | 3/2006 | Pagano | 473/270 |
| 2006/0142099 | A1 | 6/2006 | Trucks | |

* cited by examiner (Section A-A)

(Detail C)

(Detail B)

STANCE AND ROTATIONAL SWING TRAINER

CROSS-REFERENCE TO RELATED APPLICATIONS

This application claims the benefit of U.S. Provisional Application Ser. No. 61/165,243 filed on Mar. 31, 2009, the entire contents of which are herein incorporated by reference.

BACKGROUND AND SUMMARY OF THE INVENTION

A stance and rotational swing trainer for training sports players in the proper stance and rotational swing for swinging a sporting implement is provided. Embodiments of the trainer include a trainer for baseball/softball stance and rotational swing training and for golf stance and rotational swing training. Other sports may also be supported by the trainer.

A proper stance is critical to success in many sports, and players need to know the appropriate stance for their body size. For example, in the sport of baseball, the outside distance between a batter's feet should be generally twice his or her shoulder width. In the sport of golf, the distance between a golfer's feet should be generally equal to his or her shoulder width. Training players, especially young players, is made easier with a device that positions the players' feet in the proper stance without the players having to know in advance either the proper stance or their shoulder width.

The stance and rotational swing trainer provides a base upon which the player stands, a front foot stop that contacts and bounds the player's front foot and a rear foot pedal that rotatably receives the player's back foot. The stance position is adjustable by moving the front foot stop to a desired position based upon the width of the player's shoulders. A measurement scale for measuring a player's shoulders is provided on the device.

The trainer also teaches the proper rotation during swinging. Pivoting of the player's back foot is necessary for a proper swing. The trainer comprises a back foot pedal that receives the front portion of the player's back foot. The back foot pedal rotates during a swing, and a riser is provided to ensure the player's back heel rises during the swing.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
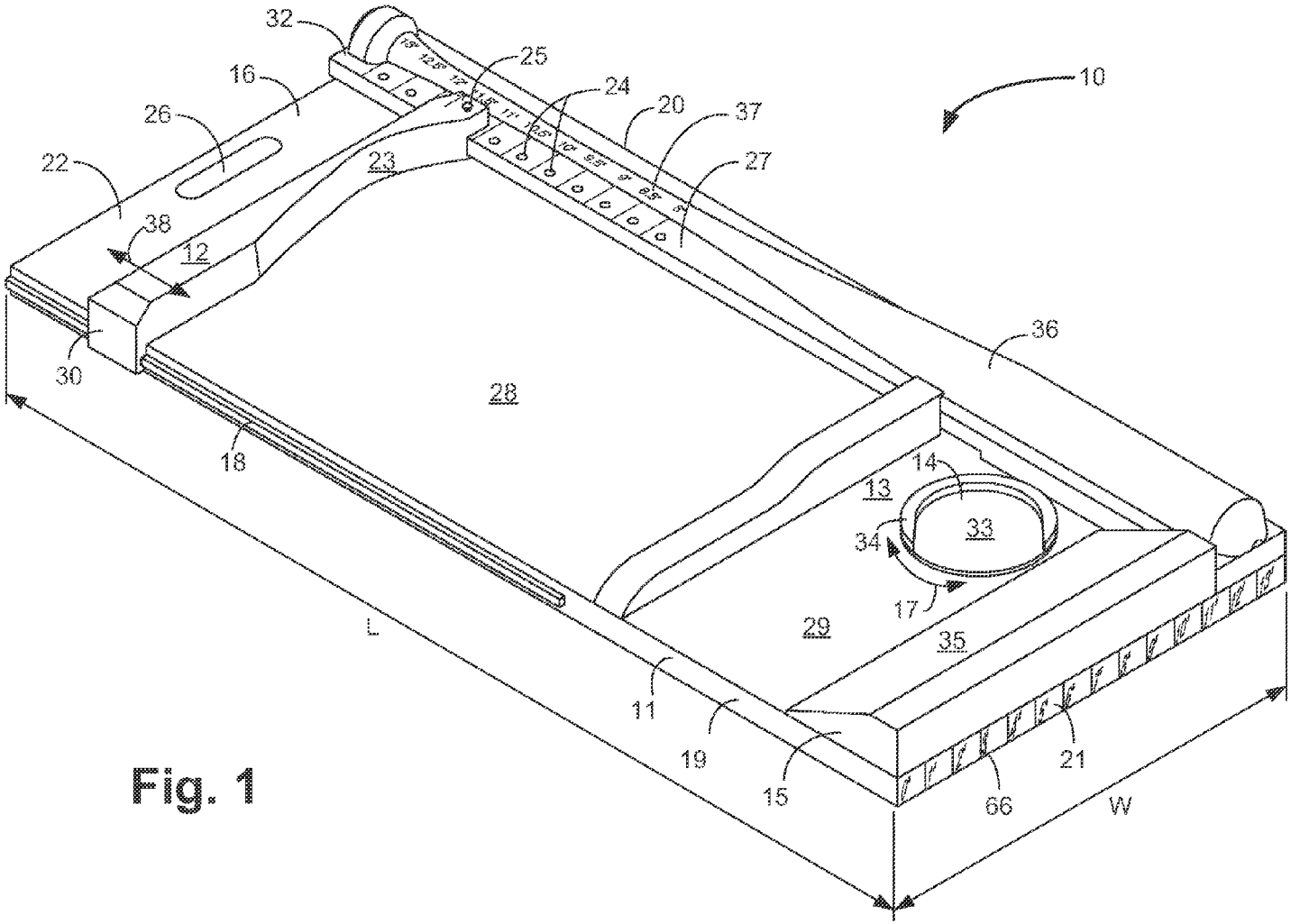
FIG. 1 is a perspective view of a stance and rotational swing trainer according to the present disclosure.

FIG. 1 depicts a stance and rotational swing trainer 10 according to an embodiment of the present disclosure. The trainer 10 comprises a base 11 that supports a user (not shown) who stands on the base 11 in order to practice a proper stance for swing training. The illustrated embodiment of the trainer 10 is intended for users with a right-handed swing, and it is understood that a trainer 10 for a user with a left-handed swing would generally be a mirror image of the illustrated trainer 10.

In the illustrated embodiment, the base 11 is generally rectangularly shaped with a length "L" that is longer than a width "W." The length L is driven by the distance between the user's feet when the user is in a proper stance for swinging a sporting implement (not shown) such as a baseball bat or a golf club, as further discussed herein. The width W is driven by the size of the user's feet (not shown).

In exemplary embodiments (not shown), a trainer 10 for youths has a length L of 32 inches and a width W of 14 inches. An exemplary trainer 10 for adults has a length L of 48 inches and a width W of 16 inches. Other dimensions may be used for the trainer 10 in other embodiments.

The base 11 has a top side 16, a bottom side (not shown), a front edge 19, a rear edge 20, a right side 21, and a left side 22. The base 11 may be formed of any suitable material, such as plastic, composite, metal, or wood. The top side 16 of the base 11 is generally flat and generally horizontally-disposed. The top side 16 supports the user during swing training. In this regard, the user places his feet (not shown) on the top side 16 of the base, as further discussed with reference to FIG. 7 herein.

The trainer 10 comprises a front foot stop 12 that is slideably attached to the base 11. Although the front foot stop 12 is slideably adjustable with respect to the base 11, as further discussed herein, it is generally immobile during swing training. The front foot stop 12 extends upwardly from the base 11 and contacts the user's front foot (not shown) during swing training. In one embodiment, the front foot stop extends upwardly 1.5 inches from the base 11, but is differently dimensioned in other embodiments.

As understood by persons with skill in the art, the term "front foot" refers to the left foot (not shown) of a user who swings right-handed and refers to the right foot of a user who swings left-handed. During use of the trainer 10, the user's front foot rests on the top side 16 of the base 11, and contacts the front foot stop 12, which prevents the user's front foot from moving further forward than the front foot stop 12.

The front foot stop 12 extends from the front edge 19 across the base 11 generally perpendicularly to the front edge 19. The front foot stop 12 comprises a stop edge 23 disposed generally perpendicularly to the top side 16. The user's front foot contacts the stop edge 23 during use of the trainer 10. The stop edge is concavely curved to better conform to a user's foot.

The front foot stop 12 is slideably attached at a forward end 30 to the front edge 19 of the base 11. In this regard, when not locked in place during use, the front foot stop 12 is slideable in the direction indicated by direction arrow 38, i.e., along the longitude of the base 11. The front edge 19 comprises a track 18 on which the front foot stop 12 slides, as further discussed herein. The track 18 is a narrow protrusion extending horizontally from the front edge 19 and extending longitudinally down the front edge as illustrated. In one embodiment, the front foot stop 12 is formed from the same material that forms the base 11. In other embodiments, the front foot stop 12 is formed from other materials.

An adjustment scale 27 is disposed on the base 11 atop a scale ledge 32. The scale ledge 32 is a raised area adjacent to the rear edge 20 that extends upwardly from the base 11. The adjustment scale 27 sets the proper position of the front foot stop 12 and restrains the front foot stop 12 in that position. In this regard, the front foot stop 12 comprises an opening (not shown) through which a alignment pin 25 is disposed. The adjustment scale 27 comprises a plurality of alignment openings 24 uniformly spaced apart from one another and in longitudinal alignment with one another and with the alignment pin 25. In order to restrain the front foot stop 12 and prevent it from moving when a user's foot contacts it, the user slideably adjusts the front foot stop 12 until the opening on the front foot stop 12 is aligned with a desired one of the plurality of alignment openings 24. Then the user inserts the alignment pin 25 into the desired alignment opening 24. To adjust the front foot stop 12, the user pulls the alignment pin 25 to remove it from the alignment opening 24, slides the front foot stop 12 to the desired location, and reinserts the alignment pin 25 into a different alignment opening 24.

The alignment scale 27 further comprises a measurement scale 37. The operation of the measurement scale 37 is discussed further herein with respect to FIG. 7 below. An ornamental bat 36 is disposed atop the scale ledge 32 in the illustrated embodiment. In other embodiments, there may be an ornamental golf club or other piece(s) of sports equipment. The measurement scale 37 is also disposed on the scale ledge 32, and in the illustrated embodiment is disposed on the lower portion of the ornamental bat 36.

A divider 13 divides the top side 16 of the base 11 into a front foot area 28, in which the user's front foot rests, and a rear foot area 29, in which the user's rear foot rests. In this embodiment, the divider 13 extends transversely across the base 11, from the front edge 19 across the width of the surface 16 of the base 11 and also extends upwardly from the base 11. The divider 13 keeps the user's rear foot (not shown) from straying into the front foot area 28 during training. In one embodiment, the divider 13 extends upwardly from the base 11 approximately 1.5 inches. In other embodiments, the divider 13 is differently-dimensioned.

A foot pedal 14 is disposed in the rear foot area 29 of the base 11. The foot pedal 14 is rotatable and receives the toe portion (not shown) of the user's rear foot such that the user may rotate his foot on the foot pedal 14 during swing training in the direction indicated by directional arrow 17.

In one embodiment, the foot pedal 14 comprises a generally flat circular pedal base 33 that rotates around its central axis (not shown). In one embodiment, the foot pedal 14 is four (4) inches in diameter in a youth embodiment, and five (5) inches in diameter for an adult embodiment. The foot pedal 14 is differently-sized in other embodiments.

The foot pedal 14 further comprises a toe stop 34. The toe stop 34 is a generally semi-circular ledge extends upwardly from the pedal base 33 and partially encircles the periphery of the pedal base 33. The toe stop 34 is sized and shaped to receive and releasably restrain a toe portion (not shown) of the user's rear foot. The toe stop 34 restrains the toe portion of the user's rear foot by contacting the toe portion and preventing it from sliding from the foot pedal 14.

An angled riser 15 is disposed on the base 11 adjacent to the foot pedal 14 as illustrated. The riser 15 comprises an angled surface 35 that angularly extends from the top side 16 of the base 11. The purpose of the angled riser 15 is to cause the user's heel to rise from the top side 16 of the base 11 when the user swings a sporting implement such as a bat (not shown), as is further discussed herein. In one embodiment, the riser 15 rises at an angle of 25 degrees from the base 11, though other embodiments use other angles for the riser 15.

A shoulder scale 66 is disposed on the right edge 21 of the base 11. The shoulder scale 66 comprises standard linear measurement markings (inches, in the illustrated embodiment) and is used to measure the user's shoulder width (not shown). The user's shoulder width may then be used to set the proper alignment of the front foot stop 12, as further discussed below with respect to FIG. 7.

A carrying handle 26 is located near the left edge 22 of the base 11. In this embodiment, the carrying handle 26 is an oblong opening extending through the base 11.

Figure 2:
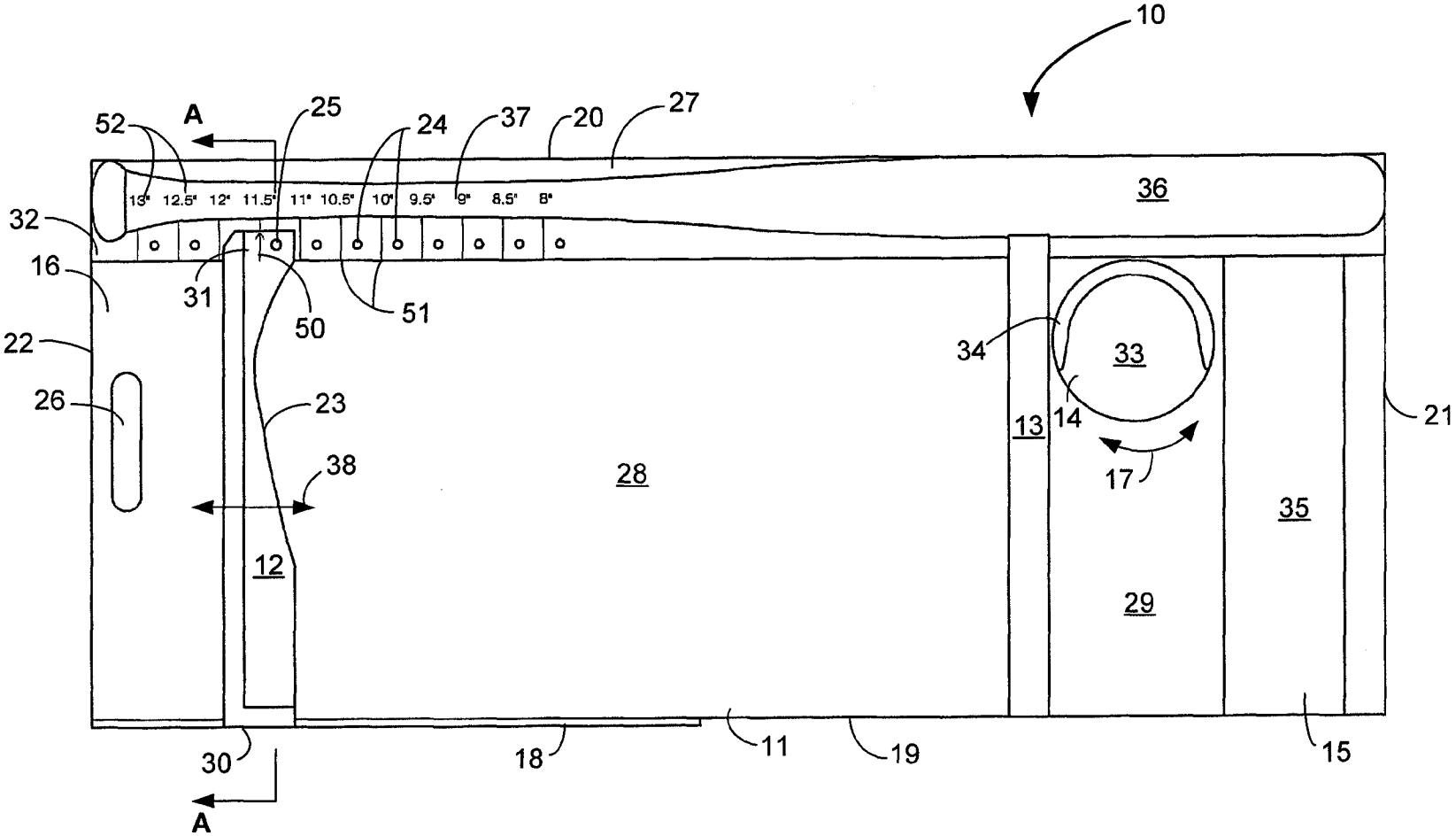
FIG. 2 is a top plan view of the stance and rotational swing trainer of FIG. 1.

FIG. 2 is a top plan view of the stance and rotational swing trainer of FIG. 1. A distal end 31 of the front foot stop 12 comprises the alignment pin 25 and overlies the plurality of openings 24 on the alignment scale 27. An alignment mark 50 is disposed on the distal end 31 of the front foot stop. A plurality of alignment marks 51 are disposed on the alignment scale 27. Each of the plurality of alignment marks 51 corresponds with a corresponding one of a plurality of measurements 52 that comprise the measurement scale 37 and a corresponding one of the plurality of alignment openings 24. When the alignment mark 50 is aligned with one of the plurality of alignment marks 51, the alignment pin 25 is aligned with one of the plurality of alignment openings 24. In this manner, the proper position of the user's front foot may be set.

By way of non-limiting example, in the illustrated embodiment, the alignment mark 50 is aligned with the alignment mark 51 that corresponds with a measurement of 11.5 inches. Further, the alignment pin 25 is received within the corresponding alignment opening 24, which sets the front foot stop at the stance distance that is appropriate for a user's shoulder measurement of 11.5 inches.

Figure 3:
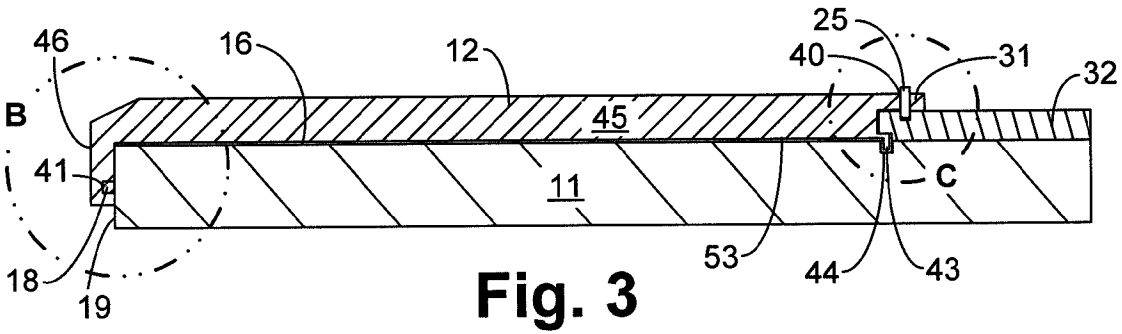
FIG. 3 is a cross-sectional view of the stance and rotational swing trainer of FIG. 2, taken along section lines "A-A" of FIG. 2.

FIG. 3 is an enlarged cross-sectional view of the stance and rotational swing trainer 10 of FIG. 1, taken along section lines "A-A" of FIG. 2. The front foot stop 12 comprises an elongated body 45 that is generally parallel to and slideably contacts the top surface 16 of the base 11. A downwardly-extending leg 46 extends downwardly from the body 45 generally perpendicular to the body 46 and contacts the front edge 19 of the base 11. The downwardly-extending leg 46 comprises a generally horizontal groove 41 that slideably receives the track 18.

The distal end 31 of the front foot stop 12 comprises an opening 40 which receives the alignment pin 25. The distal end partially overlies the scale ledge 32, as illustrated. An alignment groove 44 in the base 11 slideably receives a protrusion 43 on a lower side 53 of the body 45.

Figure 4:
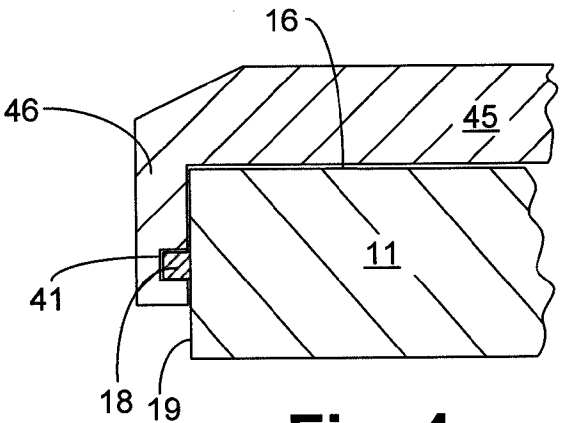
FIG. 4 is an enlarged detail view of the stance and rotational swing trainer of FIG. 3, taken along detail line "B" of FIG. 3.

FIG. 4 is an enlarged detail view of the front foot stop 12 of FIG. 3, taken along detail line "B" of FIG. 3. The generally horizontal groove 41 is disposed in an inner side wall 54 of the downwardly-extending leg 46 of the front foot stop 12. The track 18 is rigidly affixed to the front edge 19 of the base 11. In the illustrated embodiment, the track 18 is shown as having a rectangular cross section and the groove 41 is shown as having a C-shaped cross section. In other embodiments, the groove and the track may be differently configured.

Figure 5:
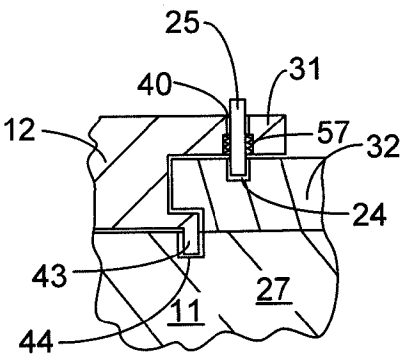
FIG. 5 is an enlarged detail view of the stance and rotational swing trainer of FIG. 3, taken along detail line "C" of FIG. 3.

FIG. 5 is an enlarged detail view of the front foot stop 12 of FIG. 3, taken along detail line "C" of FIG. 3. The distal end 31 of the front foot stop 12 overlies and slideably contacts the scale ledge 32. The alignment groove 44 in the base slideably receives the protrusion 43, which helps to slideably restrain the front foot stop 12 on the base 11.

The alignment pin 25 is captively disposed in the opening 40 and comprises a spring 57. In this embodiment, the pin 25 may be removed from the alignment opening 24 so that the front foot stop 12 may be repositioned, but the pin is restrained by the spring 57 from completely exiting the opening 40.

Figure 6:
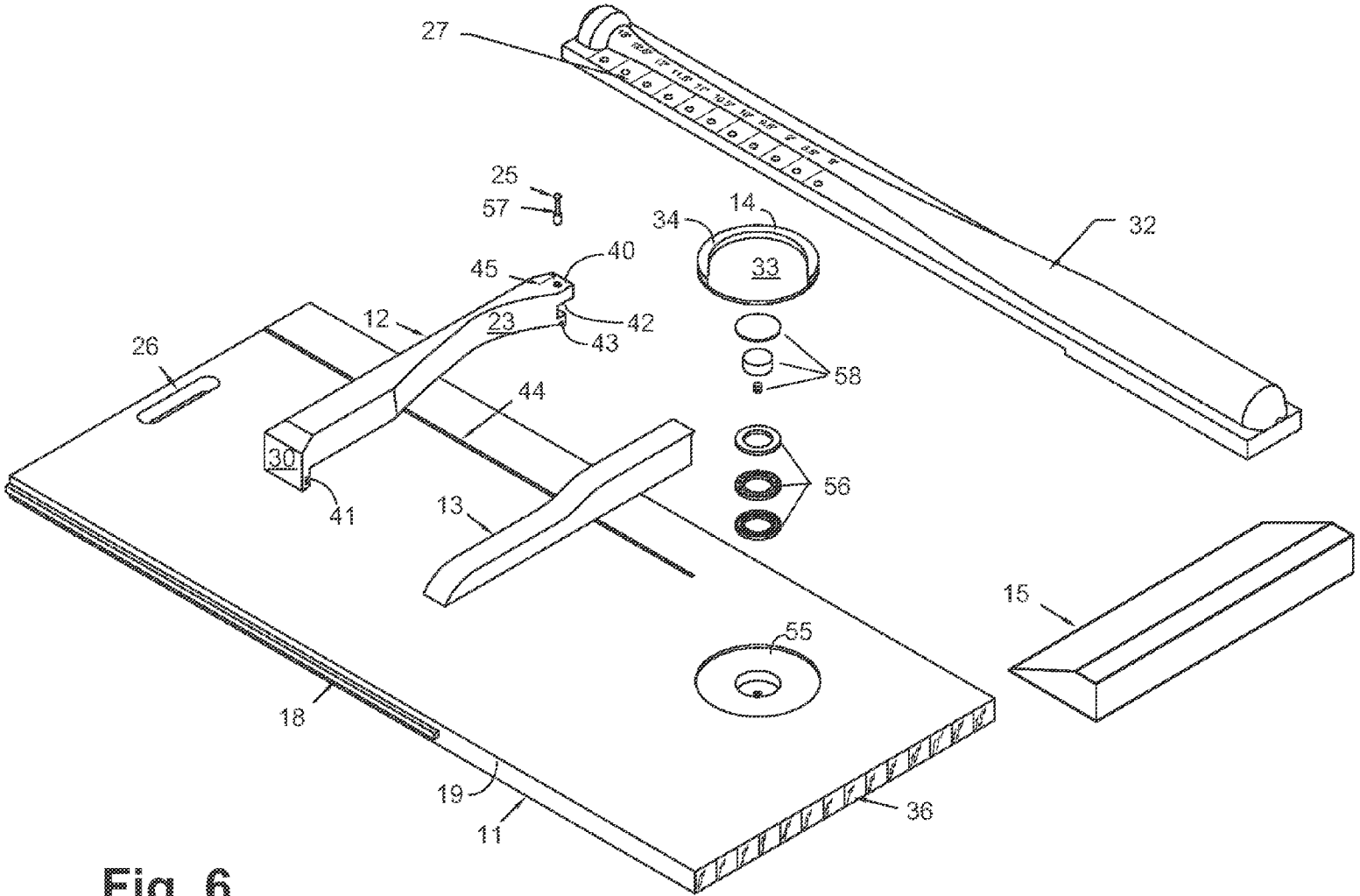
FIG. 6 is an exploded perspective view of the stance and rotational swing trainer of FIG. 1.

FIG. 6 is an exploded view of the stance and rotational swing trainer 10 of FIG. 1. The pedal 14 comprises a stem 58 that rotatably connects the pedal 14 to the base 11. The stem 58 is a one-piece, unitary construction in this embodiment, but is illustrated in exploded view to better show the shape of the lower side of the pedal. A bearing assembly 56 is disposed between the step 58 and the base and enables smooth rotation of the pedal 14. A pedal opening 55 is recessed into the base 11 and rotatably receives the pedal 14 and the stem 58. A fastener (not shown), such as a bolt or screw, rotatably secures the stem 58 to the base 11.

Figure 7:
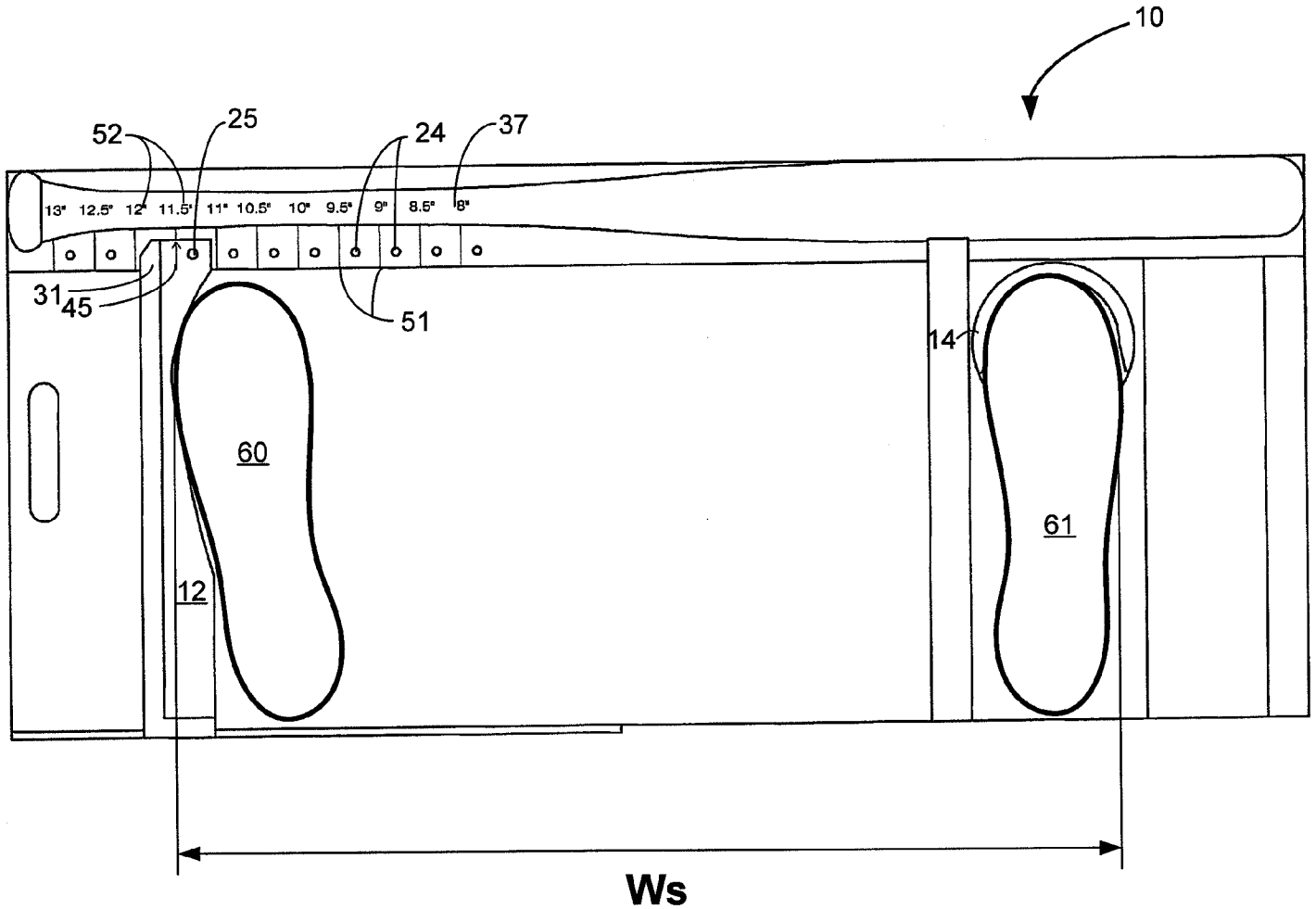
FIG. 7 is a top plan view of the trainer of FIG. 2 showing the initial position of a user's feet during stance training.

FIG. 7 is a top plan view of the stance and rotational swing trainer 10 of FIG. 1, showing an exemplary position of a user's front foot 60 and rear foot 61 during use of the trainer 10. The user's front foot 60 contacts the front foot stop 12 and the user's rear foot 61 is received by the foot pedal 14. The user's stance width "Ws" is measured between the outside edges of the user's feet, as shown. In the exemplary embodiment, which is for baseball batting training, the proper stance width Ws is twice the width of the user's shoulders. If a user's shoulder width is 11.5 inches, for example, the stance width Ws should be 23 inches.

The stance and rotational swing trainer 10 enables the user to use the trainer 10 without having to know in advance his/her proper stance width or shoulder width. Rather, the user simply measures his shoulder width using the shoulder scale 66 (FIG. 1) and sets the alignment pin 25 in the alignment opening 24 corresponding to the measurement 52 on the measurement scale 37 for that shoulder width. In the illustrated example, the user's shoulder width is 11.5 inches and the alignment mark 45 is aligned with the measurement 52 corresponding to 11.5 inches. Ws is thus two times 11.5, or 23 inches.

An embodiment of the trainer 10 used for golf (not shown) would have a different measurement scale 37 from that illustrated in FIG. 7, because a golf player's stance width Ws is generally equal to his or her shoulder width.

Figure 8:
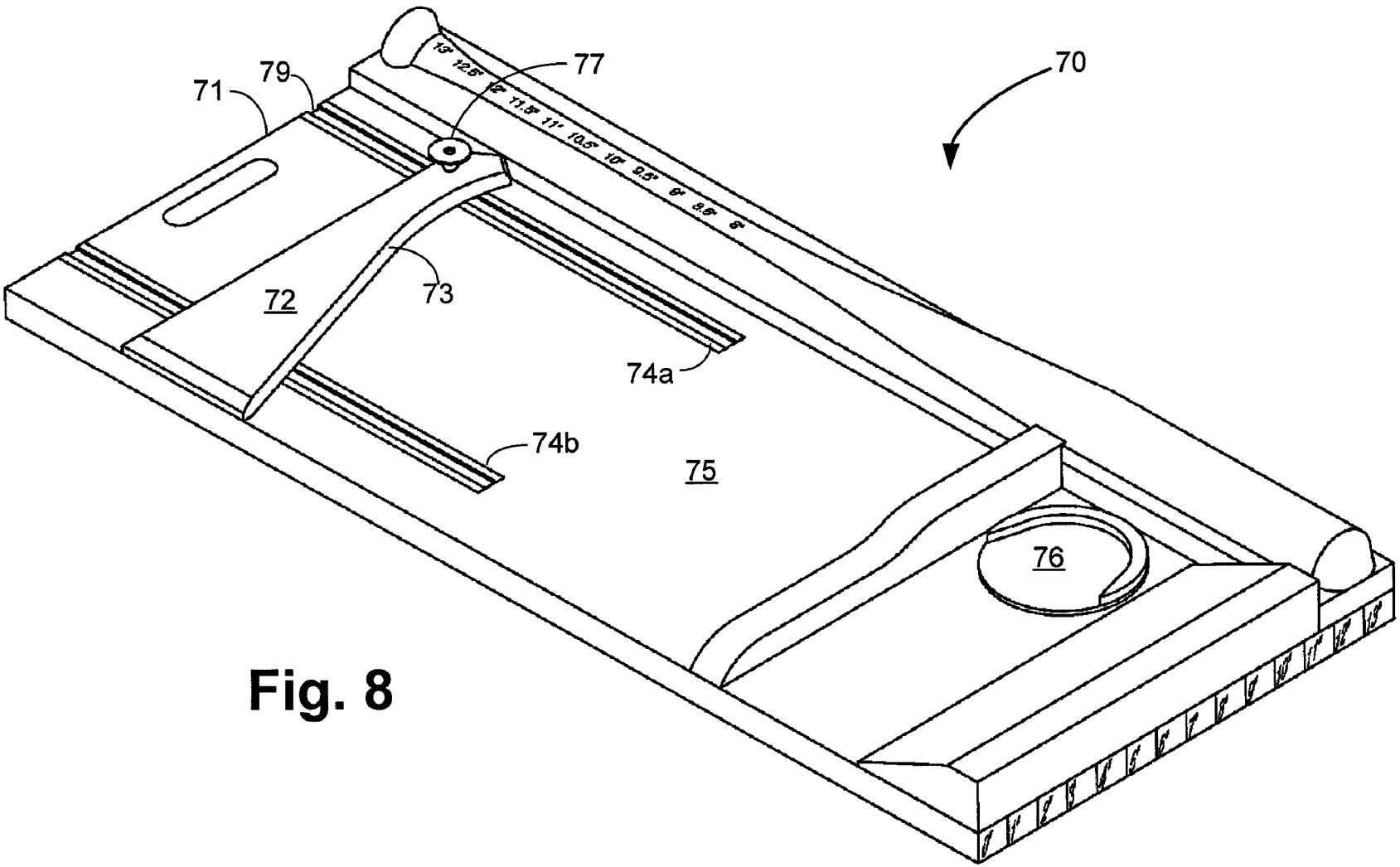
FIG. 8 is a top perspective view of an alternative embodiment of a stance and rotational swing trainer according to the present disclosure.

FIG. 8 is a top perspective view of an alternative embodiment of a trainer 70 according to the present disclosure. In this embodiment, a pair of tracks 74*a* and 74*b* extends longitudinally across a front foot area 75. The tracks 74*a* and 74*b* receive a front foot stop 72 which is adjustable by the user (not shown) to adjust the distance between the front foot stop 72 and a rear foot pedal 76.

At least one sliding pin (not shown) protrudes from the front foot stop 72 and is slideably received by a channel 79 in the track 74*a*. A hand tightening knob 77 on the front foot stop tightens the front foot stop 72 to cause it to remain fixed (i.e., to not slide) within the tracks 74*a* and 74*b*. Loosening the hand tightening knob 77 allows the front foot stop 72 to slide within the tracks 74*a* and 74*b*. In this manner, the position of the front foot stop 72 may be adjusted by the user.

Figure 9:
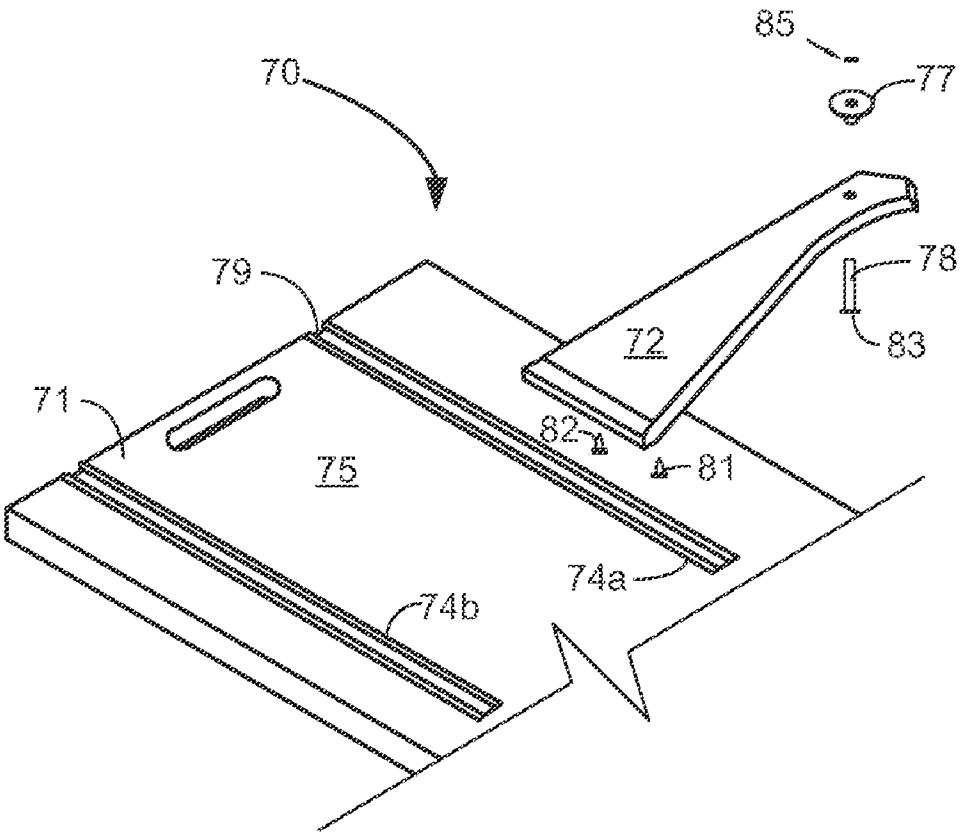
FIG. 9 is an exploded view of the front foot area of the trainer of FIG. 8.

FIG. 9 is an exploded view of the front foot area 75 of the trainer 70 of FIG. 8. A first sliding pin 78 extends through an opening 80 in the front foot stop 72 and connects to the hand tightening knob 77 via a fastener 85. In one embodiment, the sliding pin 78 is a hex head bolt and the fastener 85 is a standard nut.

A free end 83 of the first sliding pin 78 is slideably received by the channel 79 in the track 74*a*. In this embodiment, a pair of secondary sliding pins 81 and 82 extends from the front foot stop 72 and is slideably received by the track 74*b*.

What is claimed is:

1. A stance and rotational swing training device comprising:

a base;

a front foot stop adjustably attached to a top surface of the base for receiving a user's front foot;

a rotatable foot pedal rotatably attached to the top surface of the base for receiving a toe end of the user's back foot;

an angled riser rigidly affixed to the top surface of the base adjacent to the rotatable foot pedal for guiding a heel end of the user's back foot, the angled riser contactable with the heel end during rotation of the user's back foot;

a divider extending upwardly from the top surface of the base between the front foot stop and the rotatable foot pedal, the divider adjacent to the rotatable foot pedal, wherein the divider extends transversely across the width of the base and the divider is substantially parallel to the riser.

2. The stance and rotational swing training device of claim 1, wherein the divider extends upwardly from the top surface at least 1.5 inches.

3. The stance and rotational swing training device of claim 1, wherein the foot pedal comprises a generally flat circular pedal base rotating around a central axis, wherein the pedal base comprises a toe stop.

4. The stance and rotational swing training device of claim 3, wherein the toe stop comprises a semi-circularly-shaped ledge extending upwardly from the pedal base.

5. The stance and rotational swing training device of claim 1, wherein the base is substantially rectangular with opposed long edges substantially perpendicular to opposed shorter edges, one shorter edge of the base comprising a shoulder scale comprising standard linear measurement markings.

6. The stance and rotational swing training device of claim 5, further comprising an adjustment scale disposed adjacent to a long edge of the base, the adjustment scale corresponding to the shoulder scale whereby a measured width of the user's shoulders may be measured using the shoulder scale and a proper stance width for the user may be set by sliding the front foot stop to a proper stance position associated with the adjustment scale, the proper stance position corresponding to the measured width, and locking the front foot stop into the position.

7. The device of claim 6, wherein the distance between the front foot stop and the riser is twice the measured width when the front foot stop is in the proper stance position.

* * * * *